US005952919A

United States Patent [19]

Merrill

[11] Patent Number: 5,952,919

[45] Date of Patent: Sep. 14, 1999

[54] FIRE EXTINGUISHER ALARM SYSTEM

[76] Inventor: Joseph Merrill, 72 South St., Troy, N.H. 03465

[21] Appl. No.: 09/041,428

[22] Filed: Mar. 12, 1998

[51] Int. Cl.[6] ..... G08B 1/08

[52] U.S. Cl. ..... 340/539; 340/691.1; 340/693.6; 340/692

[58] Field of Search ..... 340/539, 693, 340/691, 692, 825.49, 825.36, 691.1, 693.6

[56] References Cited

U.S. PATENT DOCUMENTS 5,117,223 5/1992 Tanner ..... 340/693
5,153,567 10/1992 Chimento ..... 340/691
5,257,007 10/1993 Steil et al. ..... 340/539
5,382,943 1/1995 Tanaka ..... 340/539
5,460,228 10/1995 Butler ..... 340/568

*Primary Examiner*—Donnie L. Crosland

[57] ABSTRACT

An alarm system is provided including a plurality of remote units each having a fire or burglar alarm for generating an activation signal. A transmitter is situated within the housing for transmitting a signal via free space upon the receipt of the activation signal. Next provided is a central dispatch station including a radio receiver for receiving the signal from the transmitter of at least one of the remote units for dispatching emergency personnel to the at least one of the remote units.

14 Claims, 2 Drawing Sheets

10
42
33
40
48
26
20
32
49
64
12
22
14
24
16
18
living
Basement
Attic
bedroom
Kitch
Building
Garage
FOREST
RANGER

FIRE EXTINGUISHER ALARM SYSTEM

BACKGROUND OF THE INVENTION

1. Field of the Invention

The present invention relates to fire alarms and more particularly pertains to a new fire extinguisher alarm system for providing a system of remote units which are capable of initiating a response by emergency personnel.

2. Description of the Prior Art

The use of fire alarms is known in the prior art. More specifically, fire alarms heretofore devised and utilized are known to consist basically of familiar, expected and obvious structural configurations, notwithstanding the myriad of designs encompassed by the crowded prior art which have been developed for the fulfillment of countless objectives and requirements.

Known prior art fire alarms include U.S. Pat. No. 4,360,802; U.S. Pat. No. 4,418,336; U.S. Pat. No. Des. 250,377; U.S. Pat. No. 4,034,813; U.S. Pat. No. 5,171,079; and U.S. Pat. No. 4,592,301.

In these respects, the fire extinguisher alarm system according to the present invention substantially departs from the conventional concepts and designs of the prior art, and in so doing provides an apparatus primarily developed for the purpose of providing a system of remote units which are capable of initiating a response by emergency personnel.

SUMMARY OF THE INVENTION

In view of the foregoing disadvantages inherent in the known types of fire alarms now present in the prior art, the present invention provides a new fire extinguisher alarm system construction wherein the same can be utilized for providing a system of remote units which are capable of initiating a response by emergency personnel.

The general purpose of the present invention, which will be described subsequently in greater detail, is to provide a new fire extinguisher alarm system apparatus and method which has many of the advantages of the fire alarms mentioned heretofore and many novel features that result in a new fire extinguisher alarm system which is not anticipated, rendered obvious, suggested, or even implied by any of the prior art fire alarms, either alone or in any combination thereof.

To attain this, the present invention generally comprises a plurality of remote units. Each of such remote units includes a housing having a rectangular configuration. A rear face of the housing of each remote unit has a peripheral side wall coupled to a periphery thereof and which extends forwardly therefrom for defining an interior space and an open front. A partial front face is coupled to a top face of the peripheral side wall and extended downwardly therefrom. The housing further includes an L-shaped hammer releasably mounted on a side face of a the periphery of the housing via a U-shaped bracket. The L-shaped hammer is adapted for breaking a plate of glass mounted over the open front of the housing. Each remote housing further includes an extinguisher assembly having a fire hose situated within the interior space of the housing. Such fire hose is connected to a water source for expelling water when removed from the housing. Also situated within the housing is a fire extinguisher for dispensing a fire extinguishing material when removed. The extinguisher assembly is further equipped with a removal indicating switch connected to the fire hose and fire extinguisher. The present switch is adapted for transmitting an activation signal upon the removal of either the se or extinguisher. Mounted on the top face of periphery of the housing is a smoke detector for generating the activation signal only upon the detection of smoke. Associated therewith is a first tape player mounted within the housing and connected to the removal indicating switch of the extinguisher assembly. The first tape player is adapted for generating a message indicating the presence of a fire and a location of the housing only upon the receipt of the activation signal. As shown in FIG. 2, the remote units each include a second tape player mounted within the housing and connected to trip switch of a burglar alarm near the housing. The second tape player serves for generating a message indicating the tripping of the burglar alarm and the location of the housing only upon the tripping of the burglar alarm. Also included is a radio transmitter situated within the housing and connected to the first tape player, the second tape player, and a microphone. As shown in FIG. 1, such microphone is mounted on the partial front face of the housing. In use, the radio transmitter is adapted for transmitting either one of the messages or audible distress signals from the microphone upon the receipt thereof. Yet another transmitter, a digital location transmitter, is situated within the housing and connected to the removal indicating switch of the extinguisher assembly. The location transmitter serves for transmitting a code representative of the location of the housing only upon the receipt of the activation signal. For emitting at least one of the messages locally upon the receipt thereof, a loud speaker is mounted on the partial front face of the housing. To accomplish this, the loud speaker is connected to the first tape player and second tape player. For reasons that will soon become apparent, a radio receiver is situated within the housing and connected to the loud speaker for receiving messages via free space and emitting the same locally. FIG. 2 shows a public address system with a plurality of loud speakers connected to a radio receiver for receiving the messages and audible distress signals of the remote units and emitting the same from each of the loud speakers of the public address system upon the receipt thereof. A central dispatch station includes a radio receiver for receiving the code from the location transmitter of at least one of the remote units. A zone indicating panel provides a visual indication of the location of the housing. The dispatch station further includes a dialer for dialing emergency personnel and providing the same with the location of at least one of the remote units. By this function, the dispatch station is adapted for dispatching the emergency personnel to said location. Finally, a protective helmet is adapted to be worn by at least one of the emergency personnel. The protective helmet has a transceiver mounted therein with a speaker for receiving the messages and audible distress signals upon the receipt thereof via free space. The helmet is further equipped with a microphone for transmitting audible instruction signals to the radio receiver of at least one of the remote units.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fire extinguisher alarm system apparatus and method which has many of the advantages of the fire alarms mentioned heretofore and many novel features that result in a new fire extinguisher alarm system which is not anticipated, rendered obvious, suggested, or even implied by any of the prior art fire alarms, either alone or in any combination thereof.

It is another object of the present invention to provide a new fire extinguisher alarm system which may be easily and efficiently manufactured and marketed.

It is a further object of the present invention to provide a new fire extinguisher alarm system which is of a durable and reliable construction.

An even further object of the present invention is to provide a new fire extinguisher alarm system which is susceptible of a low cost of manufacture with regard to both materials and labor, and which accordingly is then susceptible of low prices of sale to the consuming public, thereby making such fire extinguisher alarm system economically available to the buying public.

Still yet another object of the present invention is to provide a new fire extinguisher alarm system which provides in the apparatuses and methods of the prior art some of the advantages thereof, while simultaneously overcoming some of the disadvantages normally associated therewith.

Still another object of the present invention is to provide a new fire extinguisher alarm system for providing a system of remote units which are capable of initiating a response by emergency personnel.

Even still another object of the present invention is to provide a new fire extinguisher alarm system that includes a plurality of remote units each having a fire or burglar alarm for generating an activation signal. A transmitter is situated within the housing for transmitting a signal via free space upon the receipt of the activation signal. Next provided is a central dispatch station including a radio receiver for receiving the signal from the transmitter of at least one of the remote units for dispatching emergency personnel to the at least one of the remote units.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
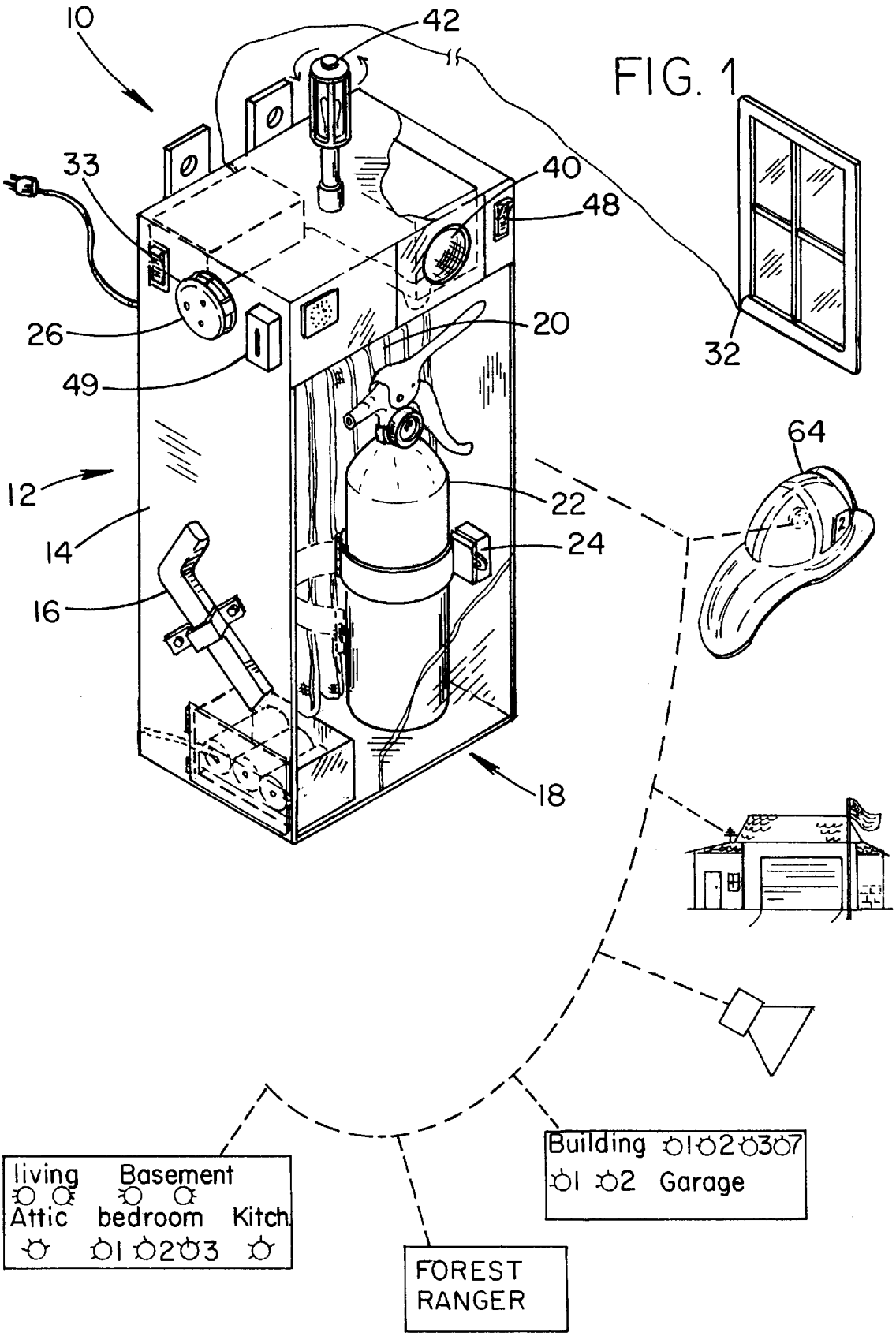
FIG. 1 is a perspective view of a new fire extinguisher alarm system according to the present invention.
Figure 2:
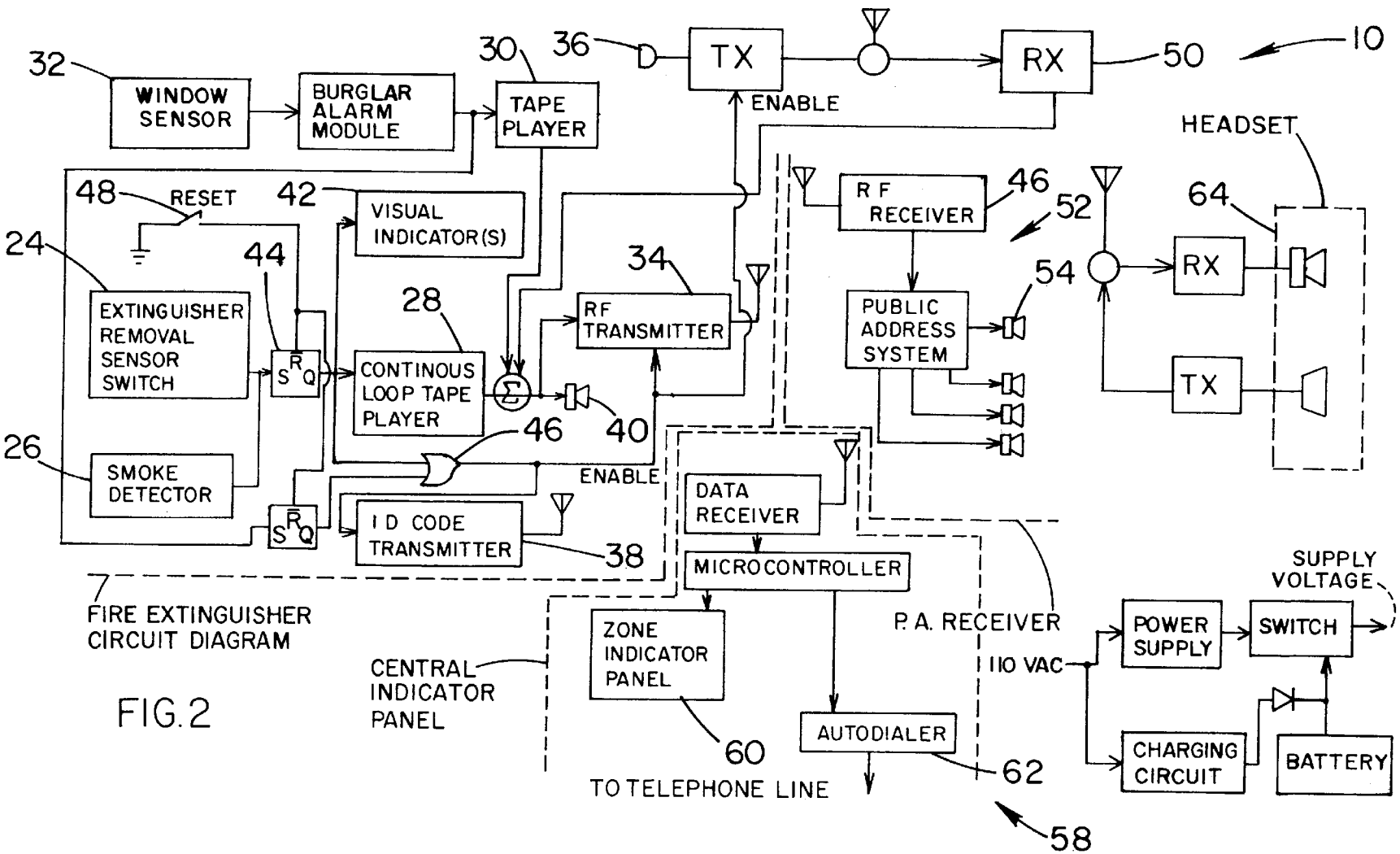
FIG. 2 is a schematic diagram of the present invention.

With reference now to the drawings, and in particular to FIGS. 1 through 2 thereof, a new fire extinguisher alarm system embodying the principles and concepts of the present invention and generally designated by the reference numeral 10 will be described.

The present invention, designated as numeral 10, includes a plurality of remote units 12. Each of such remote units includes a housing 14 having a rectangular configuration. A rear face of the housing of each remote unit has a peripheral side wall coupled to a periphery thereof and which extends forwardly therefrom for defining an interior space and an open front. A partial front face is coupled to a top face of the peripheral side wall and extends downwardly therefrom.

The housing further includes an L-shaped hammer 16 releasably mounted on a side face of the periphery of the housing via a U-shaped bracket. The L-shaped hammer is adapted for breaking a plate of glass mounted over the open front of the housing. For facilitating the convenient installation of each remote unit, a pair of tabs are mounted on the top face of housing and extend upwardly therefrom with apertures formed therein.

Each remote housing further includes an extinguisher assembly 18 having a fire hose 20 situated within the interior space of the housing. Such fire hose is connected to a water source for dispensing water with an associated valve when removed from the housing. Also situated within the housing is a dry chemical fire extinguisher 22 for dispensing a fire extinguishing material when removed. The extinguisher assembly is further equipped with a removal indicating switch 24 connected to the fire hose and fire extinguisher. The present switch is adapted for transmitting an activation signal upon the removal of either the hose or extinguisher. Such normally open switch is preferably adapted to close upon the removal of a band which securely encompasses the hose and extinguisher.

Mounted on the top face of periphery of the housing is a smoke detector 26 for generating the activation signal only upon the detection of smoke. Associated therewith is a first tape player 28 mounted within the housing and connected to the removal indicating switch of the extinguisher assembly and the smoke detector. The first tape player is adapted for playing back a prerecorded audible vocalized message indicating the presence of a fire and a location of the housing only upon the receipt of the activation signal.

As shown in FIG. 2, the remote units each include a second tape player 30 mounted within the housing and connected to trip switch 32 of a burglar alarm near the housing. The second tape player serves for playing back a prerecorded audible vocalized message indicating the tripping of the burglar alarm and the location of the housing only upon the tripping of the burglar alarm. In the preferred embodiment, the second tape player and remaining components may be selectively disengaged from the burglar alarm by way of a toggle switch 33.

Also included is a radio transmitter 34 situated within the housing and connected to the first tape player, the second tape player, and a microphone 36. As shown in FIG. 1, such microphone is mounted on the partial front face of the housing. In use, the radio transmitter is adapted for transmitting either the audible vocalized messages or audible distress signals from the microphone upon the receipt thereof. In the preferred embodiment, the audible vocalized message is continuously played and transmitted with the audible distress signals being transmitted over such message whenever received.

Yet another transmitter, a digital location transmitter 38, is situated within the housing and connected to the removal indicating switch of the extinguisher assembly and smoke detector. The location transmitter serves for transmitting a code representative of the location of the housing only upon the receipt of the activation signal.

For emitting at least one of the messages locally upon the receipt thereof, a loud speaker 40 is mounted on the partial front face of the housing. To accomplish this, the loud speaker is connected to the first tape player and second tape player. Also included is are visual indicators 42 such as strobe lights for providing a local alert of an emergency situation and further indicating the location of the remote unit that has been actuated. In some applications, the remote housings may be colored fluorescent colors for being highly visible. As will soon become apparent, the loud speaker and visual indicators allow emergency personnel to locate the remote unit.

As shown in FIG. 2, the switch of the extinguisher assembly and the burglar alarm each activate the associated tape players and the visual indicators and transmitters by way of a pair of dedicated S&R flip flops 44 and an OR gate 46. Associated therewith is a reset switch 48 which is capable of deactivating the various emergency response mechanisms of the present invention. As an option, the reset switch may be equipped with a key actuated lock 49 for allowing the depression of the switch only by authorized personnel.

For reasons that will soon become apparent, a radio receiver 50 is situated within the housing and connected to the loud speaker for receiving messages via free space and emitting the same locally. It should be noted that each remote unit is battery operated. Further options associated with each remote housing includes gas masks, a portable remote control for generating the activation signal, digital clock for indicating a current time and recording a time when the remote unit was actuated.

FIG. 2 shows a public address system 52 with a plurality of loud speakers 54 connected to a radio receiver 56 for receiving the messages and audible distress signals of the remote units and emitting the same from each of the loud speakers of the public address system upon the receipt thereof.

A central dispatch station 58 includes a radio receiver for receiving the code from the location transmitter of the remote units. A zone indicating panel 60 provides a visual indication of which remote unit is signaling. It should be noted that additional indicating panels may be associated with a local group of remote units of a common structure such as a house for providing a similar function. The dispatch station further includes a dialer 62 for dialing emergency personnel and providing the same with the location of the signaling remote units. A number of emergency personnel in the vicinity of the signaling remote unit may be selected with a look up table and/or microcontroller. By this function, the dispatch station is adapted for dispatching the emergency personnel to said location.

Finally, a protective helmet 64 is adapted to be worn by at least one of the emergency personnel. The protective helmet has a transceiver mounted therein with a speaker for receiving the messages and audible distress signals upon the receipt thereof via free space. The helmet is further equipped with a microphone for transmitting audible instruction signals to the radio receiver of at least one of the remote units. As such, emergency personnel may communicate directly with persons next to the remote unit which has been activated.

It should be noted that the present invention may be used in various environments including national parks, residential homes, airplanes, boats, schools and other industrial locations.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An alarm system comprising, in combination:

a plurality of remote units each including:

a housing having a rectangular configuration with a rear face, a peripheral side wall coupled to a periphery of the rear face and extending forwardly therefrom for defining an interior space and an open front, and a partial front face coupled to a top face of the peripheral side wall and extending downwardly therefrom, the housing further including an L-shaped hammer releasably mounted on a side face of the periphery of the housing via a U-shaped bracket for breaking a plate of glass mounted over the open front of the housing, an extinguisher assembly including a fire hose situated within the interior space of the housing and connected to a water source for expelling water when removed from the housing, a fire extinguisher situated within the housing for dispensing a fire extinguishing material when removed and a removal indicating switch connected to the fire hose and fire extinguisher for transmitting an activation signal upon the removal of either, a smoke detector mounted on the top face of periphery of the housing for generating the activation signal only upon the detection of smoke, a first tape player mounted within the housing and connected to the removal indicating switch of the extinguisher assembly for generating a message indicating the presence of a fire and a location of the housing only upon the receipt of the activation signal, a second tape player mounted within the housing for generating a message indicating the tripping of a burglar alarm near the housing and the location of the housing only upon the tripping of the burglar alarm, a radio transmitter situated within the housing and connected to the first tape player, the second tape player, and a microphone mounted on the partial front face of the housing for transmitting at least one of the messages and audible distress signals from the microphone upon the receipt thereof, a location transmitter situated within the housing and connected to the removal indicating switch of the extinguisher assembly for transmitting a code representative of the location of the housing only upon the receipt of the activation signal, a loud speaker mounted on the partial front face of the housing and connected to the first tape player and second tape player for emitting at least one of the messages locally upon the receipt thereof, and a radio receiver situated within the housing and connected to the loud speaker for receiving messages via free space and emitting the same locally;

a public address system with a plurality of loud speakers connected to a radio receiver for receiving the messages and audible distress signals of the remote units and emitting the same from each of the loud speakers of the public address system upon the receipt thereof;

a central dispatch station including a radio receiver for receiving the code from the location transmitter of at least one of the remote units, a zone indicating panel for providing visual indication of the location of the housing and a dialer for dialing emergency personnel and providing the same with the location of at least one of the remote units for dispatching the emergency personnel to said location; and a protective helmet adapted to be worn by at least one of the emergency personnel, the protective helmet having a transceiver mounted therein with a speaker for receiving the messages and audible distress signals upon the receipt thereof via free space and a microphone for transmitting audible instruction signals to the radio receiver of at least one of the remote units.

2. An alarm system comprising:

a plurality of remote units each including:

a housing, indicating means situated within the housing for generating an activation signal, and a transmitter situated within the housing for transmitting a signal via free space upon the receipt of the activation signal; and a central dispatch station including a radio receiver for receiving the signal from the transmitter of at least one of the remote units for dispatching emergency personnel to the at least one of the remote units;

wherein the indicating means includes a removal indication switch which senses the removal of a fire hose situated in the housing situated in the housing with the fire hose.

3. An alarm system as set forth in claim 2 wherein the indicating means includes a smoke detector.

4. An alarm system as set forth in claim 2 wherein the removal indication switch senses the removal of a fire extinguisher.

5. An alarm system as set forth in claim 2 wherein the indicating means includes a burglar alarm.

6. An alarm system as set forth in claim 2 wherein each remote unit includes a playback mechanism which is adapted to generate a vocal message upon the receipt of the activation signal, wherein the vocal message is adapted to be transmitted by way of the transmitter.

7. An alarm system as set forth in claim 6 wherein indicating means includes both a fire indicating means and a burglar alarm, wherein the vocal message relates to the indicating means from which the activation signal is received.

8. An alarm system as set forth in claim 6 wherein the vocal message includes a location of the remote unit.

9. An alarm system as set forth in claim 6 wherein the vocal message is transmitted via a loudspeaker mounted on the remote unit.

10. An alarm system as set forth in claim 6 wherein the vocal message is transmitted to a public address system for emitting the same over a plurality of loud speakers.

11. An alarm system as set forth in claim 2 wherein each remote housing includes a microphone for receiving audible vocal distress signals and transmitting the same via free space by way of the transmitter.

12. An alarm system as set forth in claim 11 wherein the audible vocal distress signals are received via a receiver of an emergency personal.

13. An alarm system as set forth in claim 12 wherein each remote housing includes a receiver for receiving audible vocal instruction signals from the emergency personnel via a transmitter of the emergency personnel.

14. An alarm system as set forth in claim 12 further comprising a protective helmet adapted to be worn by at least one of the emergency personnel, the protective helmet having a transceiver mounted therein with a speaker for receiving audible vocal distress signals upon the receipt thereof via free space and a microphone for transmitting audible instruction signals to at least one of the remote units.

* * * * *